US005799563A

United States Patent [19]

Harris

[11] Patent Number: 5,799,563

[45] Date of Patent: Sep. 1, 1998

[54] PISTON AND CYLINDER CLAMPING MOTOR

[75] Inventor: Burgess Clayton Harris, Addison, Ala.

[73] Assignee: Peek Brothers Investments, LLC, Sedlia, Colo.

[21] Appl. No.: 477,826

[22] Filed: Jun. 7, 1995

(Under 37 CFR 1.47)

Related U.S. Application Data

[60] Continuation of Ser. No. 238,454, May 5, 1994, abandoned, which is a division of Ser. No. 4,941, Jan. 15, 1993, abandoned.

[51] Int. Cl.[6] ..... F01B 7/20

[52] U.S. Cl. ..... 92/52; 92/53; 91/167 R; 91/156

[58] Field of Search ..... 92/51, 52, 53; 91/167 R, 281, 152, 156, 159

[56] References Cited

U.S. PATENT DOCUMENTS 3,877,349 4/1975 Schindel ..... 92/53

5,247,872 9/1993 Hoshi ..... 92/52

*Primary Examiner*—Hoang Nguyen

*Attorney, Agent, or Firm*—Holland & Hart LLC

[57] ABSTRACT

A valve spring compressor apparatus for removing and installing valve springs on automotive racing engines includes a valve seat and a compressor pump assembly. The valve seat is placed between the valve spring and the engine housing. The compressor engages the valve spring seat with a support arm and extends a piston toward the valve spring seat, thus compressing the valve spring and allowing for the removal of the retainer ring and keeper lock. The compressor uses a source of compressed air to drive a power piston into a compression chamber multiplying the supply air pressure several times. This multiplied air pressure is retained in the extension piston chamber by a one-way valve. As the extension piston extends, the multiplied air pressure in the extension piston is maintained by repeated cycling of the compressor.

2 Claims, 4 Drawing Sheets

168
130
74
156
157
174
170
176
140
72
148
142
150
84
178
78
136
82

PISTON AND CYLINDER CLAMPING MOTOR

CROSS-REFERENCE TO RELATED APPLICATION

This application is a continuation of application Ser. No. 08/238,454 filed May 5, 1994, now abandoned, which application is a division of application Ser. No. 08/004,941, filed Jan. 15, 1993, now abandoned.

BACKGROUND OF THE INVENTION

Field of the Invention

The present invention relates to a pressure fluid actuated piston and cylinder clamping motor finding particular but not exclusive use in a clamping application such as an apparatus for removing or installing the valve spring of an internal combustion engine.

OBJECTS OF THE INVENTION

It is the principal object of this invention to provide an improved pressure fluid actuated piston and cylinder clamping motor.

It is another object of this invention to provide a motor of the foregoing character which is easily and quickly actuated to provide clamping force.

It is still another object of this invention to provide a motor of the foregoing character which can be actuated to increase its working pressure force.

DETAILED DESCRIPTION OF THE PREFERRED EMBODIMENT

Figure 1:
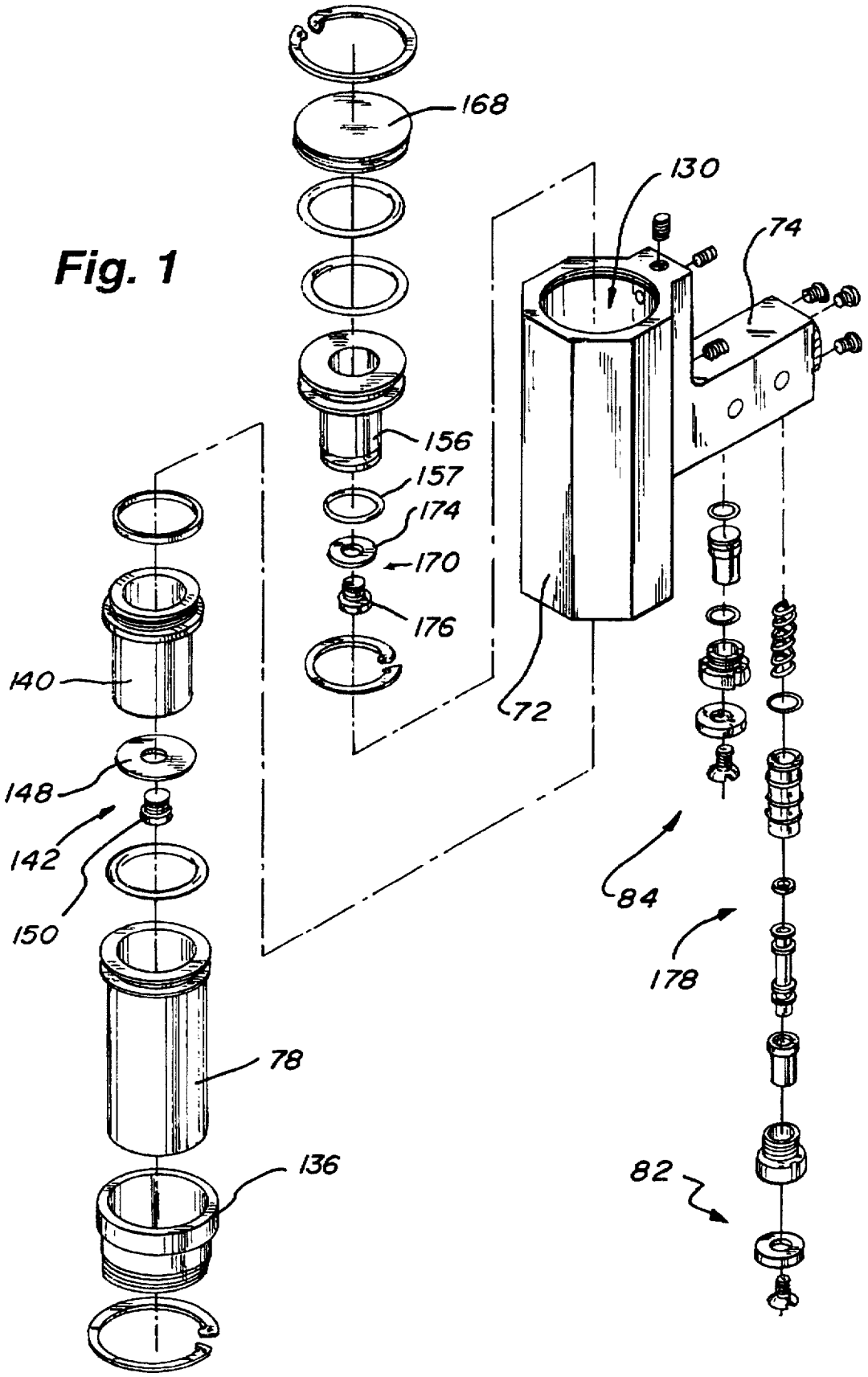
FIG. 1 is an exploded perspective view of the clamping motor embodying the present invention.
Figure 2:
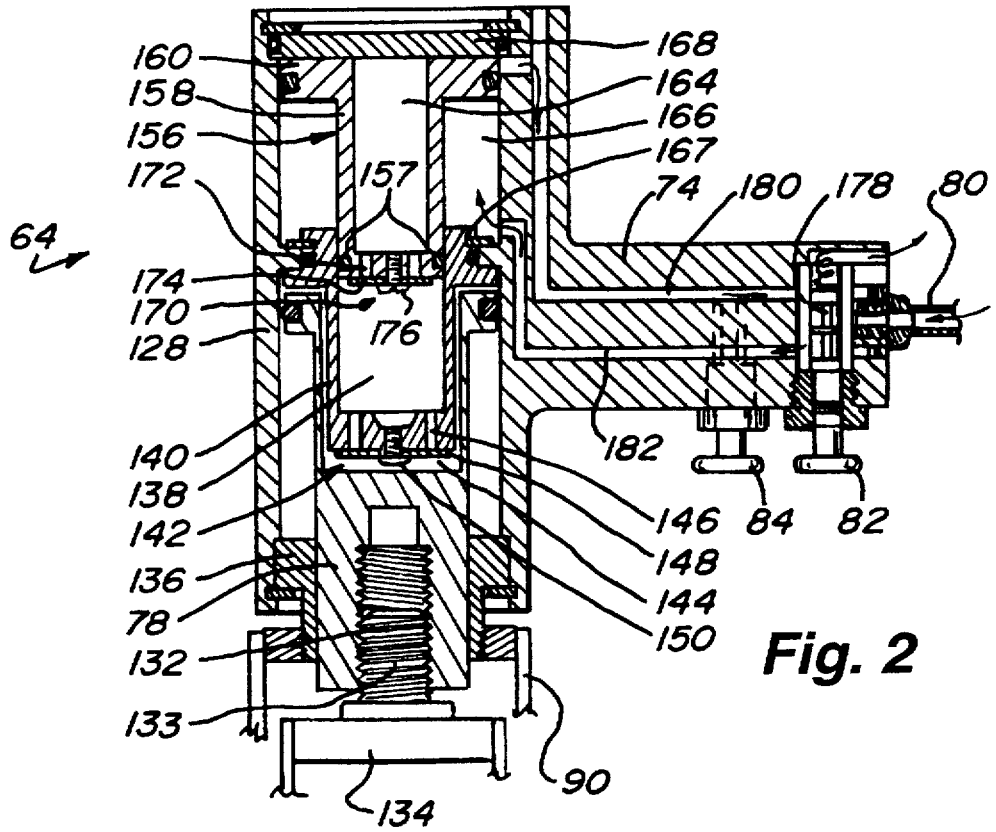
FIG. 2 is a vertical section view of the clamping motor embodying the present invention.
Figure 3:
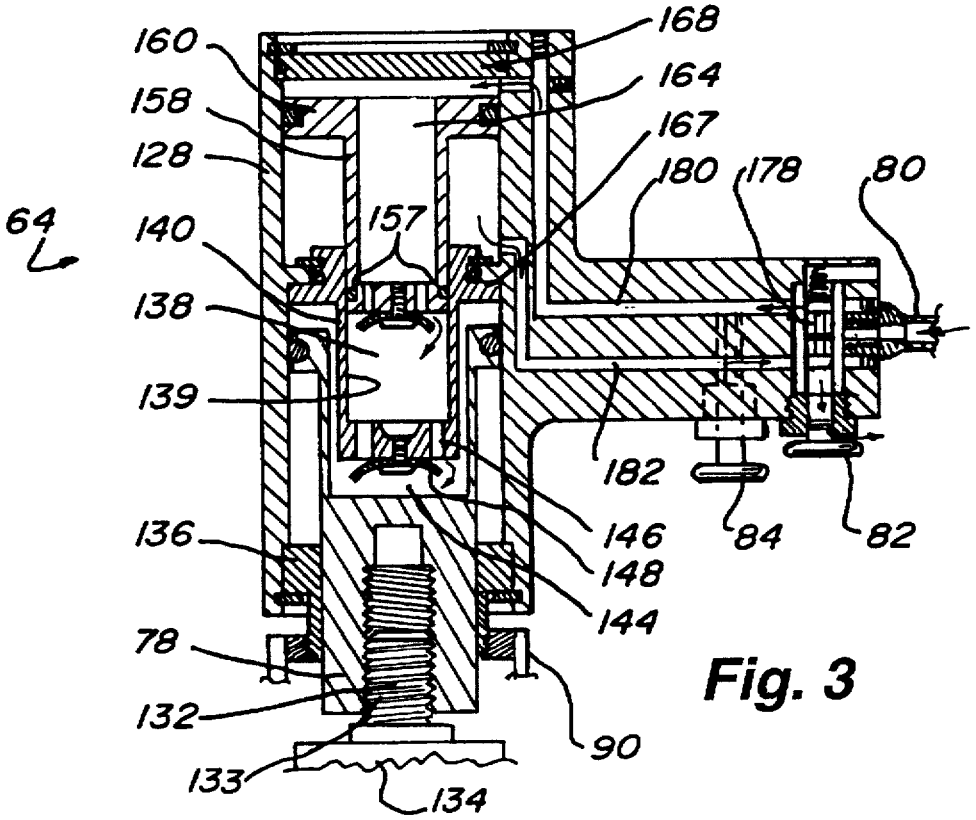
FIG. 3 is a section view similar to FIG. 2 but showing the clamping motor in an initial operating position.
Figure 4:
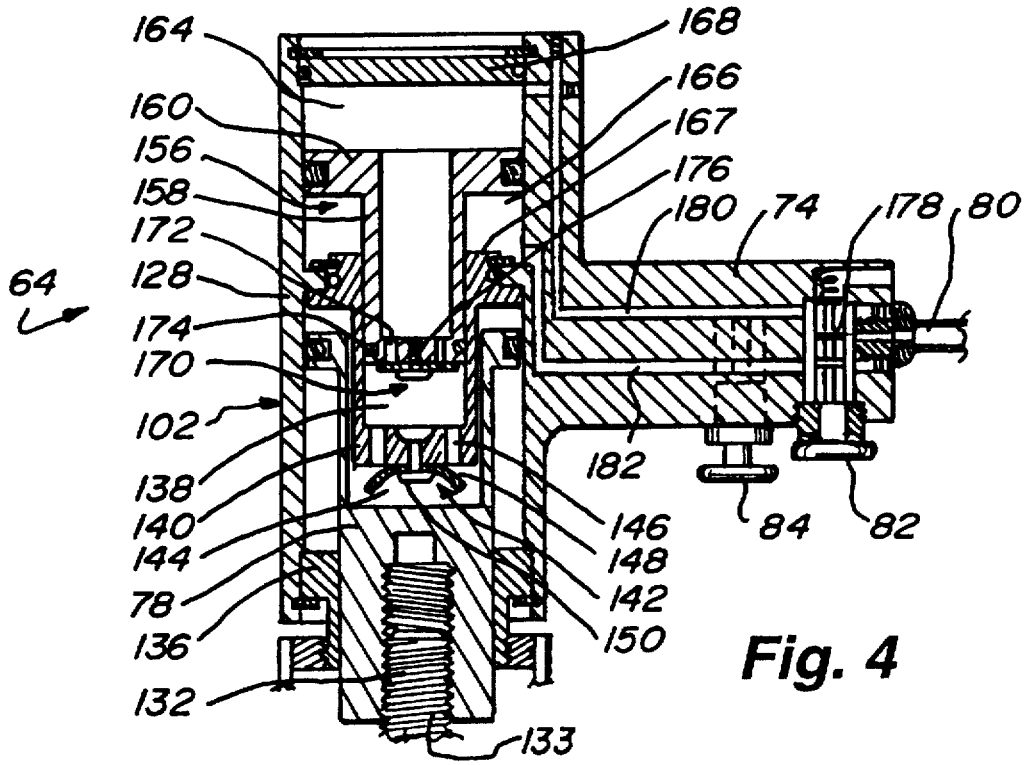
FIG. 4 is a section view similar to FIG. 2 but showing the clamping motor in a first stage compression stroke position.
Figure 5:
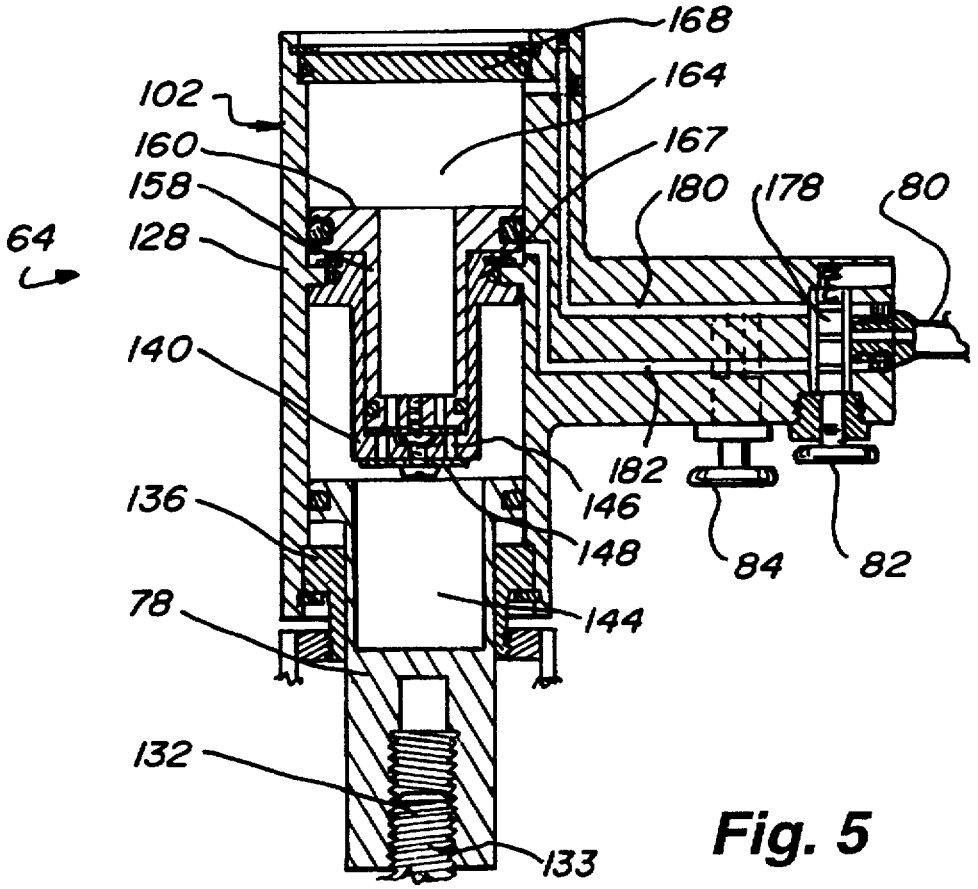
FIG. 5 is a section view similar to FIG. 2 showing the clamping motor in a first stage compression stroke position but with the clamping piston extended.

The clamping motor 64 embodying the present invention (FIGS. 1–8) is a hand-held unit comprised of a body 72 and integral handle 74. The body 72 includes a power piston 78 which extends from the body when the motor is actuated. Located on the handle 74 of the motor 64 is a coupling 80 to which a source of pressure fluid such as pneumatic compressed air supply (not shown) can be attached. Also located on the handle are two, button-actuated, control valves adapted to be pressed by an operator to control the operation of the motor 64. The first valve, a directional valve 82, actuates the motor 64. The second, a bleed valve 84, bleeds air pressure from the motor body 72 to release clamping pressure.

The power piston 78 is slidably positioned within an axially extending longitudinal cylinder bore 130 defined in a cylinder housing 128 forming a part of the motor body 72. The power piston 78 defines an internal threaded bore 132 extending along its longitudinal axis and opening into the outer end thereof to receive and support a threaded bolt 133 of a jaw plate 134. The power piston 78 slides along the inner surface of a piston guide 136 which is mounted in and attached to the lower end of the cylinder housing 128. A second jaw 90 is secured to said piston guide and extends below the power piston jaw 134. The jaws are moved toward each other by the motor 64 to provide a clamping action.

Located within the longitudinal cylinder bore 130 in the motor cylinder housing 128 is a compression chamber housing 140 defining axially therein a bore 139 forming a compression chamber 138. The compression chamber housing 140 is cylindrical in shape with one closed end and one open end. The closed end defines ports 146 extending therethrough and closed by a check valve 142 which can either allow or prevent fluid communication between the compression chamber 138 and a power piston chamber 144 defined in the cylinder 128 above the power piston 78 and between the compression chamber housing 140 and the power piston 78. The check valve 142 is a one-way valve comprised of a pliable, mylar check washer or disk 148. The check valve 142 seals the port openings when the air pressure in the power piston chamber 144 exceeds the air pressure in the compression chamber 138. The washer 148 is held in place by a screw 150. When the air pressure in the power piston chamber 144 is less than the air pressure in the compression chamber 138, the washer 148 is not forced against the compression chamber housing 140, and air pressure fluid can flow into the power piston chamber 144.

A compression piston 156 is slidably positioned in the longitudinal cylinder bore 130 of the pump housing 128, and forms a cylindrical compression piston body 158 which is received in the open end of the compression chamber 138. An O-ring 157 on the inserted end of the compression piston 156 provides a sliding seal between the piston body 158 and the cylinder bore wall 139. A flange 160 on the compression piston 156 is slidably and sealably positioned in the cylinder bore 130. An O-ring 162 located on the radial outer surface of the flange section 160 provides a fluid tight seal between the piston 156 and the cylinder bore 130 to form a piston pressure chamber 164 between the piston 156 and the closed end wall 168 of the cylinder 130. A return chamber 166 is formed by the volume between the flange 167 of the compression chamber housing 140 and the flange 160 of the compression piston 156. The compression piston 156 defines an axial bore 168 opening into the piston pressure chamber 164 and closed at the end of the piston. The piston end defines ports or passages 172 therethrough, which ports are closed by a check valve 170. The compression piston check valve 170 is similar in function and components to the power piston check valve 142 and is formed by a mylar washer 174 secured to the piston end by a screw 176. When the fluid pressure in the compression chamber 138 exceeds the fluid pressure on the power piston 156, the compression piston check valve 170 closes, and the power piston check valve 142 opens to allow the fluid pressure on the power piston to increase.

A directional valve 178 is provided to route supply air from the coupling 80 to either the compression piston chamber 164 or the compression piston return chamber 166 through a first passageway 180 or a second passageway 182.

respectively. The directional valve 178 is actuated by pressing the directional valve button 82 toward the handle 74. When the button 82 is pressed, supply air is provided to the compression piston chamber 164 through the first passageway 180. Simultaneously, the directional valve 178 vents the compression piston return chamber 166 to the ambient atmosphere through the second passageway 182. When the button 82 is released, the directional valve reverses and supply air is provided to the compression piston return chamber 166 through the second passageway 182 and the compression piston chamber 164 is vented to the ambient atmosphere through the first passageway 180.

Figure 8:
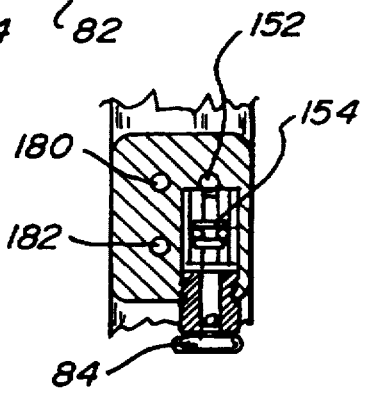
FIG. 8 is a section view taken substantially in the plane of line 8—8 on FIG. 7.
Figure 7:
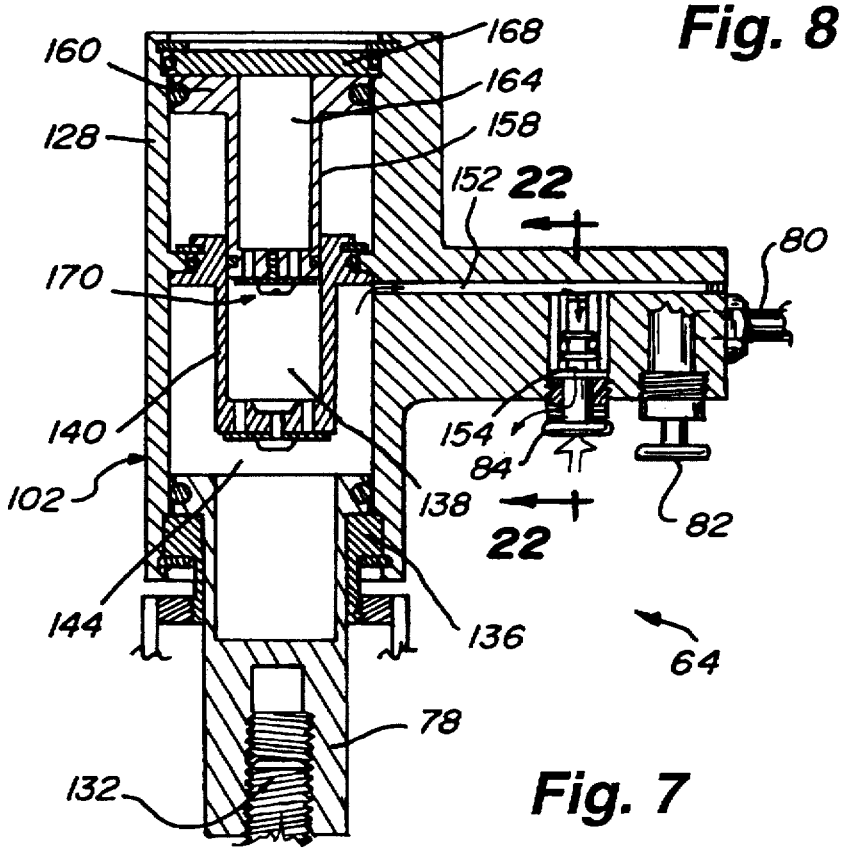
FIG. 7 is a section view similar to FIG. 5 but showing the clamping motor in a pressure force release position.

A third passageway 152 leads from the extension piston chamber 144 through the handle 74 of the motor assembly 64 to a bleed valve 154 (FIGS. 7 and 8). The bleed valve 154 is actuated by pressing the bleed valve button 84 toward the handle. With the button 84 in this position, there is open fluid communication from the extension piston chamber 144 to the ambient atmosphere through the third passageway 152. In this manner, actuation of the bleed valve 154 bleeds fluid pressure from the pump assembly 102.

In operation, a pressurized source of supply (not shown) of pressure fluid, compressed air in the present example, is connected to the coupling 80 and the bleed valve is actuated to normalize the air pressure in the power piston chamber 144 so that the power piston is in a retracted state. The supply air pressure in the power piston return chamber 166 will drive the compression piston 156 against the back wall 168.

Figure 6:
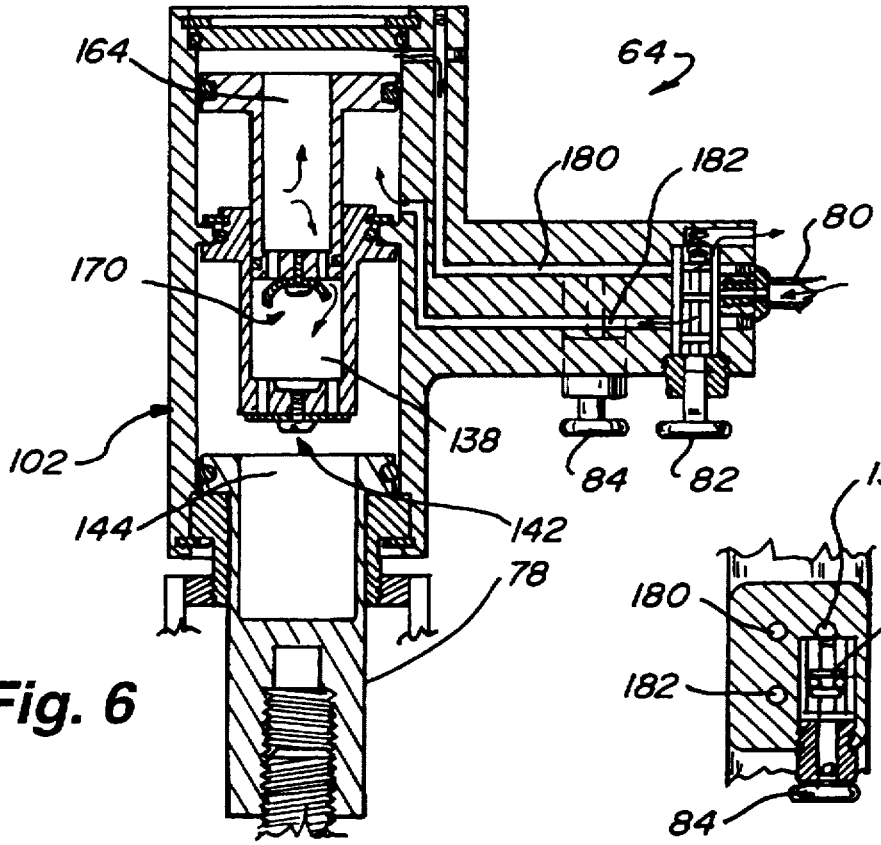
FIG. 6 is a section view similar to FIG. 2 but showing the clamping motor in a beginning position for a second stage compression stroke position.

To begin a clamping operation, the directional valve 178 is actuated to direct compressed air to the compression piston chamber 164. The compression piston return chamber 166 is simultaneously vented to the atmosphere (FIG. 6). The force exerted against the compression piston 156 by the compressed air pressure in the compression piston camber 164 exceeds the force exerted against the compression piston flange 160 in the compression piston return chamber 166 and drive the compression piston longitudinally into the compression chamber 138 to compress the air therein. Both the compression piston check valve 170 and the extension piston check valve 142 open to supply compressed air from the compression chamber 138 to the power piston chamber 144 as well as the compression chamber 138. This pressure increase in the extension piston chamber 144 drives power piston 78 outwardly until it meets a clamping surface with a force which is equal to the supply air pressure multiplied by the surface area of the power piston exposed to the compressed air.

When movement of the power piston 78 stops as the clamp jaw 134 engages the surface being clamped, air pressure in the power piston chamber 144 and compression chamber 138 increases to greater than the air pressure in the expanding compression piston chamber 164 and the compression piston check valve 170 closes. The surface area of the compression piston 156 in the compression chamber 138, which area is normal to the direction of movement of the piston, is smaller than the surface area of the compression piston 156 in the compression piston chamber 164, normal to the direction of movement of the piston. Preferably, the normal surface area in the power piston chamber 164 is 4.5 times greater than the normal surface area in the compression chamber 138. Therefore, the power piston will be forced into the compression chamber 138 until the air pressure in the compression chamber 138 and power piston chamber 144 is 4.5 times greater than the supply air pressure, or until the compression piston 156 abuts the closed end of the compression chamber 138, whichever comes first. As a result, the power piston 78 exerts a greater force against the application surface. At this point, the extension piston check valve 142 closes, trapping the multiplied air pressure in the power piston chamber. The first pressure multiplication cycle is now complete.

To further increase the power piston force, the operator releases the button of the directional valve 82 whereupon the valve shifts to vent the supply air from the compression piston chamber 164 and provide supply air to the compression piston return chamber 166. This causes the compression piston to be returned to its initial position adjacent the back wall 168. As the compression piston 156 retracts from the compression chamber 138, the volume of the compression chamber 138 expands and compressed air flows into the chamber 138 through the piston check valve 170 forced out of the compression piston chamber 164.

When the operator again shifts the directional valve 82, the supply air drives the compression piston 156 into the compression chamber 138 as before, further compressing the air, and multiplying the air pressure therein. The piston check valve 170 remains closed, resulting in a pressure multiplication of 4.5. When the fluid or air pressure in the compression chamber exceeds the pressure in the power piston chamber 144, the compressed air flows into the chamber 144 through the piston check valve 142. In this way a multiplied pressure force is developed in the power piston chamber 144. Repeated cycling through pressure multiplication cycles increases the output force of the motor.

As can be appreciated, the present invention provides the capability of easily increasing an applied force. It can be seen that with a pressure multiplication factor of 4.5, and with a supply air pressure of one hundred pounds per square inch (PSI), the pressure in the power piston chamber will be 450 PSI. Because the diameter of the power piston is 2.25 inches, the normal surface area is 3.97 square inches. Thus, the power piston is capable of exerting a clamping force of 3.97 square inches times 450 PSI or over 1785 pounds. Even when a low-end compressed air source having only 60 PSI is used, a clamping force of over 1070 pounds can be achieved.

While certain illustrative embodiments of the present invention have been shown in the drawings and described in detail in the specification, it should be understood that there is no intention to limit the invention to the specific form and embodiments disclosed. On the contrary, the intention is to cover all modifications, alternative constructions, equivalents and uses falling within the spirit and scope of the invention as expressed in the appended claims.

It is claimed:

1. A piston and cylinder fluid pressure clamping motor activated by pressure fluid from a pressure fluid source and comprising, in combination, a tubular housing defining a cylinder extending axially therethrough, a plate at one end of said housing sealingly closing said cylinder, an annular piston guide mounted in said cylinder at the other end of said housing, a power piston slidably mounted in said guide and having one end extending axially outwardly of said housing, the opposite end of said piston having a flange thereon, a seal on said flange slidingly and sealingly engaging the wall of said cylinder, a tubular second stage housing sealingly fixed within said cylinder and defining a second stage cylinder, said second stage cylinder having a closed end adjacent said piston and an open end opposite thereto, said closed end defining a pressure fluid flow passage therethrough, a check valve operatively closing said passage for precluding the flow of return pressure fluid therethrough, a floating compression piston slidably mounted in said cylinder and said second stage cylinder, a flange on one end of said compression piston slidably and sealingly engaged with said cylinder, a seal on the other end of said compression piston slidably and sealingly engaging said second stage cylinder, a pressure fluid passage extending axially through said compression piston, a check valve on the end of said piston inserted into said second stage cylinder for precluding return pressure fluid flow therethrough, an arm on said housing extending laterally therefrom and connected to said pressure fluid source, said arm defining a pressure fluid passage for directing pressure fluid from said source to said cylinder adjacent said end plate and said compression piston for applying fluid pressure to said compression piston in a direction away from said plate, said arm further defining a pressure fluid passage for directing pressure fluid from said source to said cylinder between said compression piston and said fixed second stage housing for applying pressure fluid to said compression piston in a direction toward said cylinder cap, a control valve on said arm for selectively controlling the flow of pressure fluid to said pressure fluid passages to increase the fluid pressure on said power piston, a pressure fluid exhaust passage opening into said cylinder between said power piston flange and said second stage cylinder housing for exhausting pressure fluid therefrom, and an exhaust valve on said arm for controlling the exhaust of pressure fluid from said exhaust passage and thereby the release of the fluid pressure on said power piston.

2. A piston and cylinder fluid pressure clamping motor activated by pressure fluid from a pressure fluid source and comprising, in combination, a tubular housing defining a cylinder extending axially therethrough and opening into one end of said housing, the other end of said housing being closed, a power piston slidably mounted in said cylinder and having one end extending axially outwardly of said housing, a seal on the opposite end of said piston slidingly and sealingly engaging the wall of said cylinder, a tubular second stage housing sealingly fixed within said cylinder and defining a second stage cylinder, said second stage cylinder having a closed end adjacent said piston and an open end opposite thereto, said closed end defining a pressure fluid flow passage therethrough, a check valve operatively closing said passage for precluding the flow of return pressure fluid therethrough, a floating compression piston slidably mounted in said cylinder and said second stage cylinder, a flange on one end of said compression piston slidably and sealingly engaged with said cylinder, a seal on the other end of said compression piston slidably and sealingly engaging said second stage cylinder, a pressure fluid passage extending axially through said compression piston, a check valve on the end of said compression piston inserted into said second stage cylinder for precluding return pressure fluid flow therethrough, a pressure fluid conduit for directing pressure fluid from said source to said cylinder adjacent the closed end of said housing and said compression piston, a pressure fluid conduit for directing pressure fluid from said source to said cylinder between said compression piston and said fixed second stage housing for applying pressure fluid to said compression piston in a direction toward said closed housing end, a control valve for selectively controlling the flow of pressure fluid to said pressure fluid passages to increase the fluid pressure on said power piston, a pressure fluid exhaust passage opening into said cylinder between said power piston and said second stage housing for exhausting pressure fluid therefrom, and an exhaust valve for controlling the exhaust of pressure fluid from said exhaust passage and thereby the release of the fluid pressure on said power piston.

* * * * *